US005347736A

United States Patent [19]

Kanigan

[11] Patent Number: 5,347,736

[45] Date of Patent: Sep. 20, 1994

[54] ILLUMINATED SIGN

[75] Inventor: Kim W. Kanigan, Saskatoon, Canada

[73] Assignee: Sign-Rite Inc., Canada

[21] Appl. No.: 670,546

[22] Filed: Mar. 15, 1991

[51] Int. Cl.[5] ..... G09F 13/04

[52] U.S. Cl. ..... 40/576; 40/618; 362/812

[58] Field of Search ..... 40/564, 571, 572, 574, 40/575, 576, 578, 611, 618; 362/227, 234, 812

[56] References Cited

U.S. PATENT DOCUMENTS

| | | | |
|---|---|---|---|
| 1,352,031 | 9/1920 | Schaffner | 40/618 X |
| 3,722,120 | 3/1973 | Finkel | 40/618 |
| 3,742,633 | 7/1973 | Palm | 40/576 |
| 4,553,345 | 11/1985 | Bercier et al. | 40/618 X |
| 4,693,026 | 9/1987 | Callahan et al. | 40/576 |
| 4,817,316 | 4/1989 | Walker | 40/5 X |
| 4,848,017 | 7/1989 | Bailey et al. | 40/576 |
| 5,088,221 | 2/1992 | Bussiere et al. | 40/576 X |

*Primary Examiner*—Brian K. Green
*Attorney, Agent, or Firm*—Gowling, Strathy & Henderson

[57] ABSTRACT

An illuminated sign comprises a housing containing a light source and having a sign face defining a side of the sign. The housing has upright end members and cross members extending between the end members, each member defining an inwardly directed locating channel and an undercut locating channel. The edge portions of the sign face are received in the locating channels. Right angle corner brackets are provided for location in the connecting channels to join the frame members.

30 Claims, 6 Drawing Sheets

ILLUMINATED SIGN

FIELD OF THE INVENTION

This invention relates to an illuminated sign, and more particulary, but not exclusively, to an illuminated sign comprising a number of ready-to-assemble parts that may be shipped to a customer for assembly, and a sign having provision for modification of the face of the sign.

BACKGROUND OF THE INVENTION

It is known to provide illuminated signs comprising a rectangular housing containing a light source typically in the form of one or more fluorescent tube units and provided with one or two sign faces which are illuminated by the lights in the sign. The sign faces may be in the form of a single, translucent sheet, painted or marked as desired, or the sign face may be divided into a number of horizontal rows to receive interchangeable panels bearing alphanumeric characters or other symbols. The panels are formed of blocks or panels of transparent material and the characters may be defined by providing, on the face of the panel, a transparent portion defined by an opaque coating. Thus, with the light from the interior of the housing, behind the panel, the transparent portion is highly visible.

One of the problems associated with the use of such reverse type letter panels is of light transmission from between adjacent panels. One method of overcoming this problem is disclosed in Canadian Patent No 1,252,293 issued on Apr. 11, 1989 to Wagner Zipchange Inc. in which an opaque strip or partition is coupled to a lateral edge of a letter panel to abut and overlap an immediately adjacent panel.

Signs of this form are also often adapted to permit the rearranging of the letter panels such that, for example, a store may modify the sign to advertise different items or to change displayed prices. On the other hand, it is desirable that the signs are tamperproof and not readily modified or rearranged by unauthorized persons.

Signs of this form are generally of fairly large dimensions and thus are expensive to store and transport. Certain transport difficulties may be overcome by mounting the sign on a trailer, but this adds significantly to the cost of the sign and may facilitate theft of an unattended sign.

SUMMARY OF THE INVENTION

According to one aspect of the present invention there is provided an illuminated sign comprising a housing containing a light source and having a sign face defining a side of the sign. The housing has a perimeter frame defined by upright end members and cross members extending between the end members, each member defining an inwardly directed locating channel and an undercut connection channel. Edge portions of the sign face are received in the locating channels. Right angle corner brackets are provided for location in the connection channels to join the frame members.

Preferably, at least one intermediate cross member is provided to divide the side of the sign into at least two separate sections. The upper and lower perimeter cross members each define one inwardly directed locating channel and the intermediate cross member defines two oppositely directed locating channels. Thus, the sign face may be provided in a plurality of separate sections, one section being located between the adjacent cross members. This permits a sign to be provided in the form of, for example, a number of rows of characters or lettering.

Each sign face section may comprise a plurality of letter panels, at least some of the letter panels being formed of transparent material having an opaque covering defining a transparent, reverse image of an alphanumeric character or other symbol. The light source behind the sign face thus provides a high contrast background with the result that the character or symbol defined by the transparent area is highly visible.

The letter panels may be provided with cooperating overlapping ends, and one overlapping end of each panel may be of opaque material to prevent light transmission between the panels, which would otherwise reduce the clarity and resolution of the sign. Alternatively, the panels may have planar ends and be provided with opaque end caps. In a still further alternative arrangement, each sign face section may comprise a block sheet of transparent material and a plurality of letter panels for locating in front of the block sheet. The block sheet may remain in the sign, while the letter panels may be replaced and reordered to vary the message displayed on the sign. The block sheet may serve to weatherproof the sign, but may be removed to gain access to the interior of the sign to, for example, repair or replace the light source. Each block sheet may include a plurality of upright, opaque strips for location behind the abutting ends of adjacent letter panels to minimize light transmission between the letter panels. If desired, the block sheet may be tinted such that the characters or symbols defined by the letter panels appear coloured. Also, the block sheet may be provided with a varying tint, more pronounced adjacent the light source, to provide a more evenly lit sign face.

Where a block sheet is provided, each locating channel may be provided with a back portion for receiving an edge of a block sheet and a front portion for receiving an edge of a letter panel.

To allow withdrawal of the sign face from the housing, the locating channel of one of the members may be moveable to an open position. This permits the sign face to be readily altered or removed and replaced without having to dismantle the sign. Locking the moveable locating channel in a closed position prevents unauthorized tampering with the sign face. The moveable locating channel may be pivotally moveable relative to the main body of the member between a closed position and an open position, to allow withdrawal of the sign face from the housing. The pivotal connection may be in the form of a hinge extending over the length of the member. A locking plate may also be provided for location over the end member to prevent opening of the locating channel.

It is preferred that the light source is in the form of a self-contained unit mounted to an inner face of a member for directing light towards the member forming the opposite side of the housing. Most preferably, the light source is in the form of a floodlight unit. The opposite member may be provided with a reflective surface to reflect light back towards the light unit to minimize dark spots behind the light unit. The inner faces of the other members may also have reflective surfaces to disperse the light more evenly within the housing. The reflective surfaces may be provided by reflective paint or an adhesive backed mirrored sheet or polished. For increased brightness, two self-contained floodlight units may be provided and mounted to opposing inner faces of the members, each unit being arranged to direct light towards the opposite member. Floodlights may have aluminum foil tape wrapped around the edges of the bulbs to eliminate curved light streaks on panels.

The light source may include an external light sensor which is located in an aperture in the member used to mount the light unit; during the day the sign may be sufficiently visible without internal lighting, but as the level of external light falls the sensor will activate the light source to illuminate the sign.

According to a further aspect of the present invention, there is provided an illustrated sign comprising a housing for mounting two sign faces with a light source mounted in the housing between the sign faces. The housing has a perimeter frame defined by upright end members and cross members extending between the end members, each member defining two inwardly directed locating channels with one locating channel on each edge. The sign faces define the sides of the sign and have edge portions which are received in the locating channels. The locating channels of one of the members are moveable to an open position to allow withdrawal of the sign faces from the housing.

According to a still further aspect of the present invention, there is provided a method of assembling an illuminated sign comprising:

a) providing frame members, each member defining an inwardly directed locating channel and an undercut connection channel;

b) providing right angle corner brackets;

c) locating the corner brackets in the connection channels and joining the frame members end-to-end to define a rectangular housing;

d) providing a light unit;

e) mounting the light unit to a frame member;

f) providing a sign face; and g) locating the edge portions of the sign face in the locating channels and mounting the sign face in the housing.

The frame members may be provided in unit lengths. To assemble a sign of a larger area, a number of frame members are joined end-to-end using connecting plates extending between the connection channels of adjacent frame members.

The frame members may be provided in unit widths. To assemble a sign of greater depth a number of frame members may be joined side-by-side using connecting brackets having a front wall and a clamp portion for engaging the locating channels of adjacent frame members.

BRIEF DESCRIPTION OF THE DRAWINGS

These and other aspects of the present invention will now be described, by way of example, with reference to the accompanying drawings, in which.

DETAILED DESCRIPTION OF DRAWINGS

Figure 1:
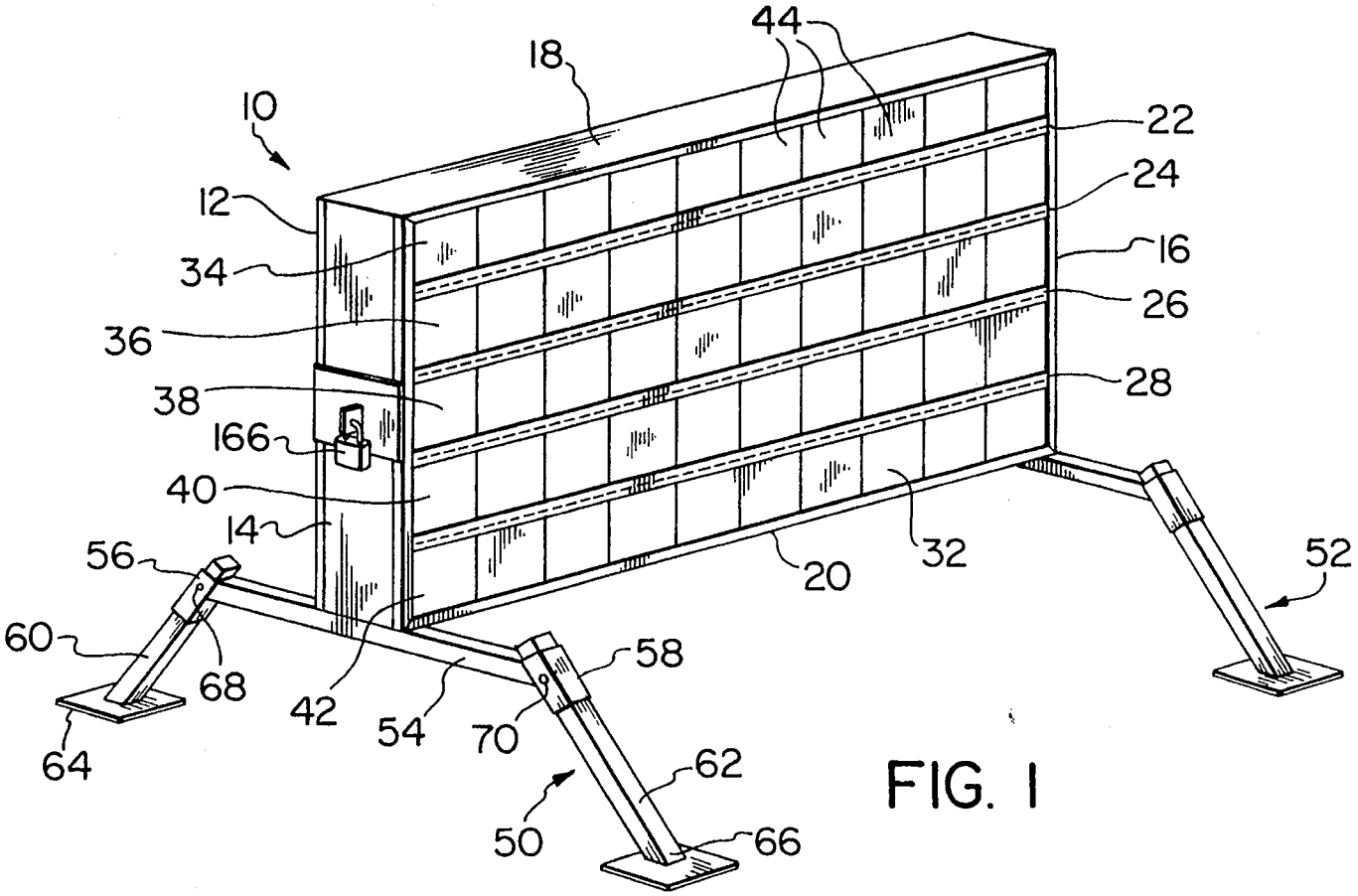
FIG. 1 is a perspective view of an illuminated sign in accordance with a preferred embodiment of the present invention.

Reference is first made to FIG. 1 of the drawings which illustrates an illuminated sign 10, in accordance with a preferred embodiment of the present invention. The sign 10 comprises a rectangular perimeter housing 12 formed of two upright end members 14, 16 and upper and lower cross members 18, 20. Further intermediate cross members 22, 24, 26, 28 are further provided for extending between the end members 14, 16. Similar intermediate cross members are provided on the opposite face of the sign, which is a mirror image of the face illustrated in FIG. 1. To avoid repetition, the face of the sign visible in FIG. 1 will be described as exemplary of both.

A sign face 32 defines one side of the sign and, in this example, is divided into five separate sections or rows 34, 36, 38, 40, 42 by the intermediate cross members 22, 24, 26, 28. Each row is formed of a number of letter blocks or panels 44 formed of transparent material which, as will be described, define alphanumeric characters or punctuation symbols defined by an opaque covering on the transparent panels. Some of the panels may also be completely opaque. The panels 44 are removable and may be rearranged to carry different messages. During daytime, the message carried by the sign may be simply read from the panels by passerbys and at night time, additional contrast is provided by a light source inside the sign, which light is visible through the transparent portions of the letter panels 44.

Figure 2:
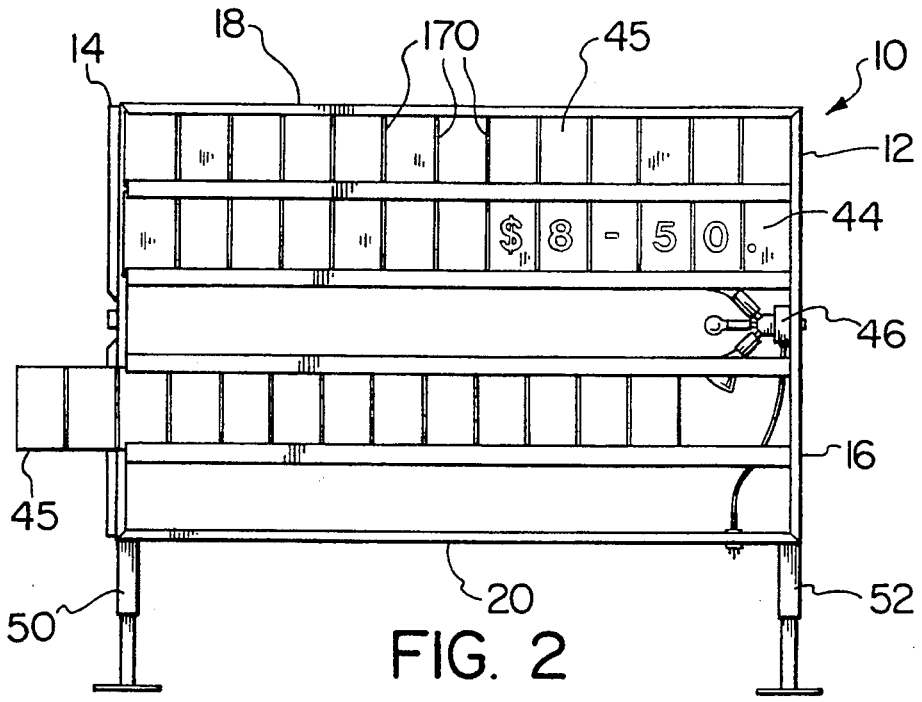
FIG. 2 is an elevational view of the sign of FIG. 1, showing elements of the sign face removed to reveal the interior of the sign.

Reference is now also made to FIG. 2 of the drawings, which illustrates one end of the sign in an open configuration showing a number of letter panels 44 in place and also a number of transparent back sheets 45 which are provided behind the letter blocks. It should be noted that the panels 44 may be used without back sheets 45 as will be described. FIG. 2 also illustrates the light source, in the form of a floodlight unit 46 mounted on an end member 16.

In this particular embodiment, the sign housing is shown mounted on a pair of supports 50, 52 bolted to the ends of the lower cross member 20. Each support 50, 52 comprises a square section horizontal tube 54 (FIG. 1), having inclined square sections sleeves 56, 58 welded to the ends of the tube 54. The sleeves 56, 58 receive legs 60, 62 formed of square section tubing and provided with feet in the form of rectangular plates 64, 66. The height of the sign may be adjusted by sliding the legs 60, 62 through the sleeves 56, 58, where the legs are held in position by bolts which pass through aligned holes in the sleeves and legs and which engage a nut 68, 70 welded over the hole on one side of the sleeve. Also, each of the foot plates 64, 66 is provided with a hole to receive an anchoring pin.

Figure 3:
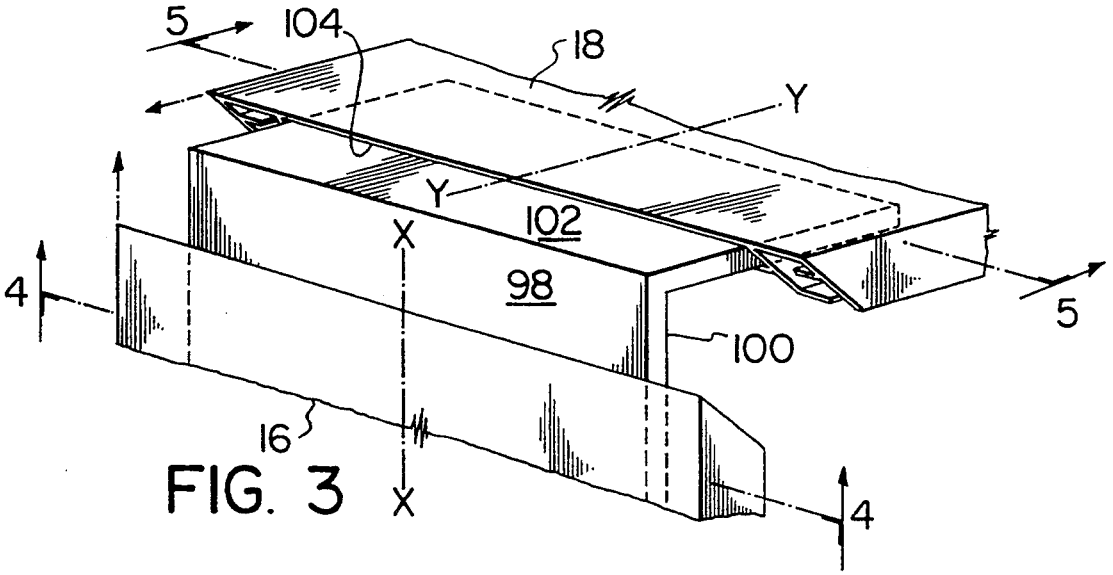
FIG. 3 is a view of area 3 of FIG. 1, shown enlarged and with elements of the signs separated.
Figure 4:
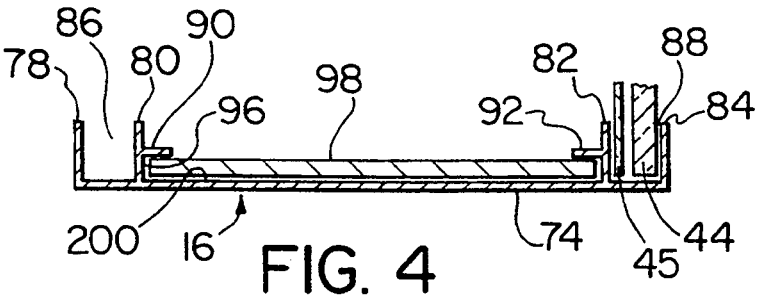
FIG. 4 is a sectional view on line 4—4 of FIG. 3.

The configuration of the end members 14, 16 and the upper and lower cross members 18, 20 will now be described, with particular reference being made to FIGS. 3, 4 and 5 of the drawings. The upper and lower cross members 18, 20 are both of similar form, though the end members 14, 16 do differ, as will be described. The end member 16 will be described initially and is illustrated, in section, in FIG. 4 of the drawings. The member 16 comprises a planar, perimeter wall 76 with four flanges 78, 80, 82, 84 extending inwardly from the wall 76. The member 16 is symmetrical about a longitudinal axis, shown as line X—X on FIG. 3. Each pair of flanges 78, 80 and 82, 84 define a locating channel 86, 88 for receiving an edge portion of a sign face. The right hand side of FIG. 4 shows the edges of a letter panel 44 and a block or back sheet 45 received in the channel 88 (in some embodiments the back sheet 45 may be omitted). The inner flanges 80, 82 further include short flange portions 90, 92 which, together with the flanges 80, 82 and the perimeter wall 76 define an undercut channel 96 adapted to receive one leg 98 of a right angle corner bracket 100, as may be seen in FIG. 3. The other leg 102 of the bracket 100 is received in a corresponding undercut channel 104 in the upper or lower cross member 18, 20, as appropriate. The bracket 100 is preferably formed of aluminum alloy.

Figure 5:
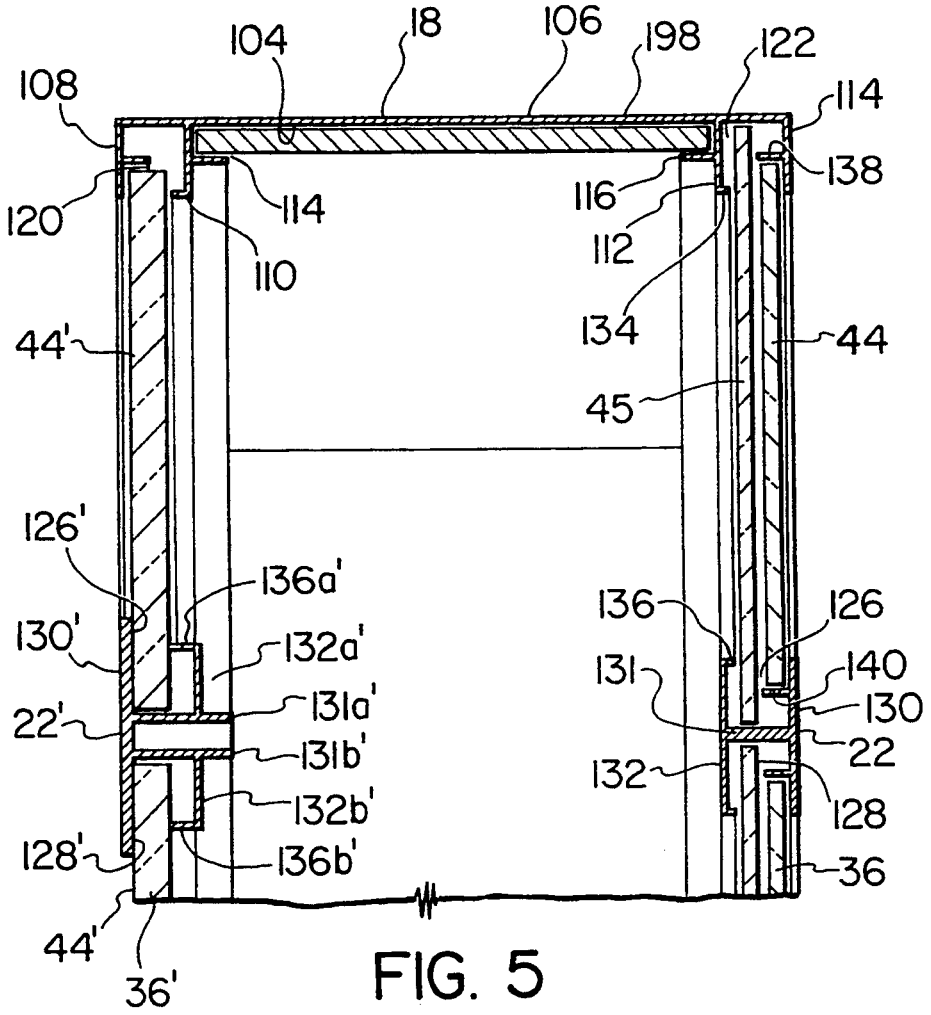
FIG. 5 is a sectional view on line 5—5 of FIG. 3.

A sectional view of the upper cross member 18 is shown in FIG. 5 of the drawings, where it may be seen that the channel 104 is defined by a perimeter wall 106, two inner flanges 110, 112 and two flange portions 114, 116 which extend towards one another from the flanges 110, 112. The member 18 is also provided with outer flanges 108, 114 which, together with the flanges 108, 110 and 112, define locating channels 120, 122. As with the end members 16, the upper cross member 18 is symmetrical about a longitudinal axis Y—Y (FIG. 3), such that only one side of the member need be described.

The locating channel 122 provided by the upper cross member 18 differs from the locating channels provided by the end member 16 in that the locating channel 122 has front and rear portions, the front portion for receiving edge portions of letter panels 44 and the rear portion for receiving an edge of a back sheet 45. As may be seen from FIG. 5 of the drawings, the intermediate cross member 22 defines a locating channel 126 of similar form to the locating channel 122, and also defines a second locating channel 128 for receiving the upper edge portions of the letter panels and back sheet of the second row 36 of the sign face. The cross member 22 includes a front flange 130 and a rear flange 132 joined by a cross piece 131 which together define the locating channels 126, 128.

The back sheets 45 are of greater height than the letter panels 44 and the upper end faces of the back sheet extend to the bases of the channels 122, 126. Short flange portions 134,136 extend forwardly from the flanges 112, 132 to abut a rear face of the back sheet 45, while further flange portions 138, 140 extend rearwardly from the flanges 114, 130 to locate the front face of the back sheet. The flange portions 138, 140 extend from midpoints of the respective flanges and also serve to locate the top and bottom faces of the letter panels 44. The arrangement is intended to permit removal and replacement of both the back sheet 45 and the letter panels 44 and also to facilitate removal and replacement of letter panels 44 while the back sheet 45 remains in place.

FIG. 5 also includes a further form of simplified intermediate cross member 22', on the opposite side of the sign, which defines a locating channel 126' and an oppositely directed second locating channel 128' for receiving the upper edge portion of the letter panels 44' of a second row 36' of the sign face. The cross member 22' includes a front flange 130' and two rear flanges **132*a'*, 132*b'* joined by spaced-apart cross pieces 131*a'*, 131*b'*. Short flange portions 136*a'*, 136*b'* extend forwardly from the respective flanges 132*a'*, 132*b'* to abut rear faces of the letter panels 44', while the front faces of the panels 44' abut the front flange 136'**.

In further embodiments an intermediate cross member may be provided with a profile similar to the member 22' and also provided with flange portions extending rearwardly of the front flange 130', similar to flange portions 140, for use with a back sheet.

As mentioned above, in some embodiments, the back sheet 45 may be omitted and only panels 44' located in the locating channels, as illustrated in the channel 120 and intermediate cross member 22. It will be noted that the panel 44' is somewhat thicker than the panels 44 used with the back sheet 45 in order to occupy the width of the channel 120.

Removal of the back sheets 45 and letter panels 44 or the letter panels 44', is made possible by the configuration of the end member 14, which is illustrated in some detail of FIG. **6*a* of the drawings. It will be noted that the Figure illustrates only panels 44' being used without back sheets 45. Elements common to both members 14, 16 will be designated with primed numerals in the description of the member 16. The general form of the end member 14 is generally similar to the end member 16 as illustrated in FIG. 4, having an undercut channel 96' to receive legs of a right angle connecting bracket 100 and locating channels 86', 88' to receive the end edge portions of back sheets and letter panels. The end member 14 is formed of an extrusion similar to that which forms the end member 16, but in which the perimeter 74' wall is cut at the base of the flanges 80', 82' and the angle members 144, 146 resulting are joined to the main body by piano hinges 150, 152 which are rivetted to and extend over the length of the member 14. Thus, the angle members 144, 146 may be configured in a closed position, as shown in FIG. 6, in which the members 144,**

Figure 7:
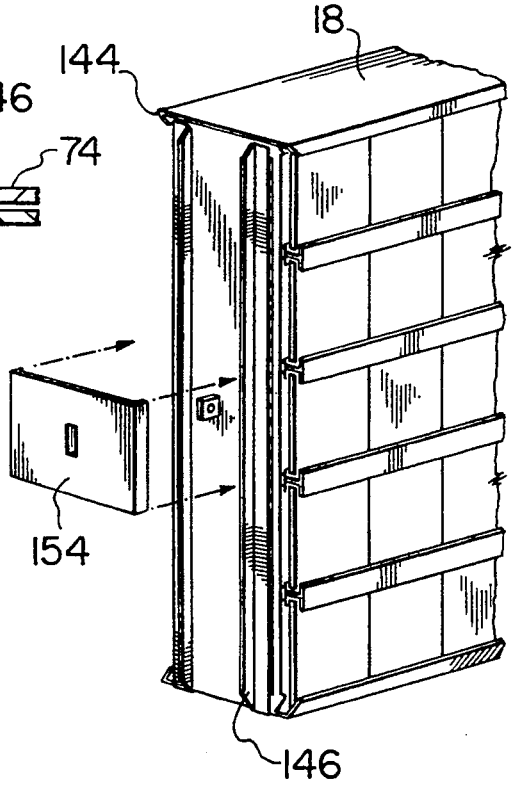
FIG. 7 is a perspective view of the end of the sign shown in FIG. 6*a*, showing the end of the sign opened to allow removal and replacement of elements of the sign face.

146 define two walls of the locating channels 86', 88' or may be opened, as illustrated in FIG. 7 of the drawings, to allow withdrawal of the letter panels, and, as illustrated in FIG. 7, the back sheets where provided.

To maintain the angle members 144, 146 closed a locking plate 154 is placed over the end of the member 14, the plate 154 being of corresponding width to the member 14. The plate 154 is held in place by an angle bracket 156 having a portion 158 bolted to the inside of the member 14 and a tongue 160 extending through a complementary aperture punched in the end member 14. The tongue 160 is adapted to extend through an aperture 162 punched in the locking plate 154. The tongue 160 is apertured at 164 to receive the hook of a padlock 166 (FIG. 1).

Figure 6A:
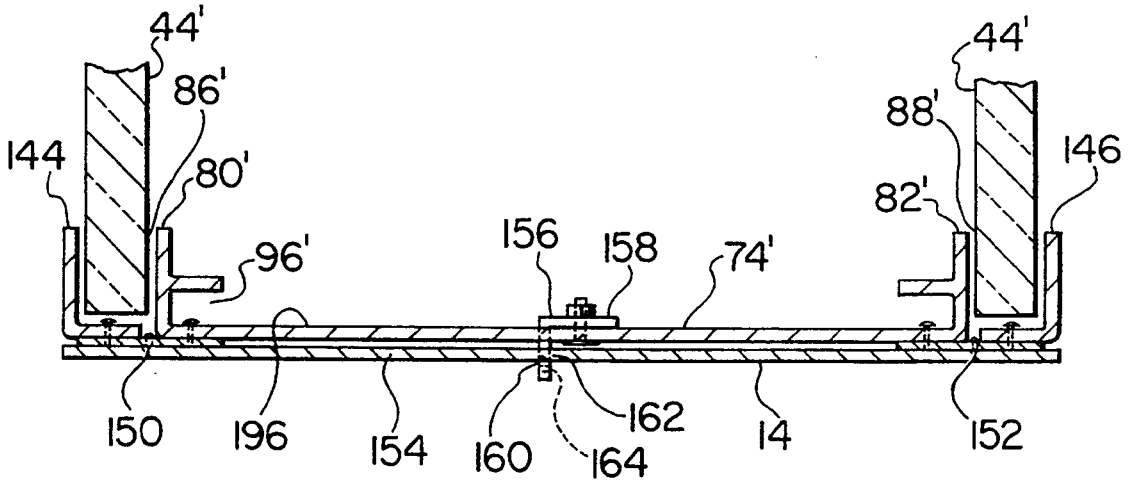
FIG. 6*a* is a sectional view on line 6—6 of FIG. 1.
Figure 6B:
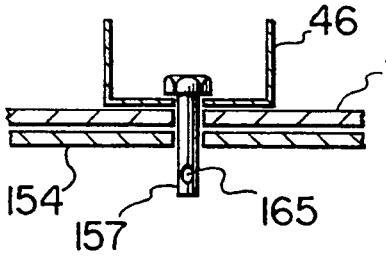
FIG. 6*b* is a sectional view corresponding to FIG. 6*a* and illustrating an alternative configuration of a sign element.

FIG. 6*b* illustrates somewhat different means for locating the locking plate 154, in the form of a bolt 157 which is threaded through an opening in the back of a light unit 46. The bolt 157 is provided with a padlock receiving aperture 165.

The various frame members are preferably formed of aluminum alloy extrusions and the locking plate 154 formed of aluminum alloy.

The back sheet 45 and letter panel 44 configuration will now be described, reference being first made to FIG. 2 of the drawings. Each back sheet is in the form of a thin, rectangular sheet of transparent material. Marked on each sheet is a plurality of equally spaced, opaque strips 170 located such that the strips will be positioned directly behind the spaces between the ends of adjacent letter panels 44 that are placed in the sign. The opaque strips 170 are intended to prevent light from passing between the individual panels. Further, the back sheet 45 helps to prevent wind and rain from entering the interior of the sign.

Figure 8:
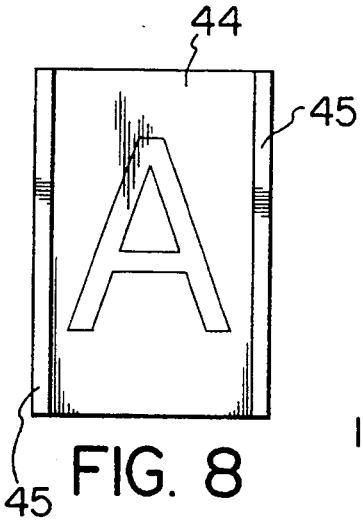
FIG. 8 is a front view of a letter panel for use with the sign of FIG. 1.
Figure 9:
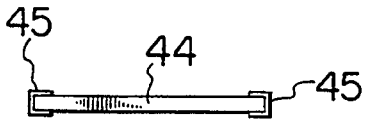
FIG. 9 is a plan view of the letter panel of FIG. 8.

In their simplest form, the letter panels 44 comprise a rectangular panel of transparent material with an alphanumeric character or symbol presented as a clear portion surrounded by an opaque block portion for defining the appropriate character or symbol. When used in conjunction with a back sheet, the letter panels may have planar side edges. Such a panel 44 is illustrated in FIGS. 8 and 9 of the drawings. The panel 44 is shown provided with opaque end caps 45, in the form of thin walled channels which are placed over the edges of each panel to prevent light from passing through the edges of the letters and causing "light leaks". The channels 45 may be plastic extrusions and are fastened to the letter panels using an adhesive.

If it is desired to use the letter panels without a back sheet, it is desirable to provide the letter panels with overlapping or bevelled edges and opaque edge portions to prevent light from passing between the panels.

Figure 10:
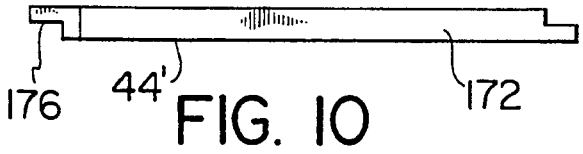
FIG. 10 is a plan view of a further letter panel for use with the sign of FIG. 1.
Figure 11:
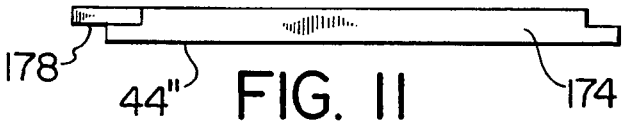
FIG. 11 is a plan view of a still further letter panel for use with the sign of FIG. 1.

FIGS. 10 and 11 of the drawings illustrate two alternative forms of letter panels 44', 44''. Both the illustrated panels are preferably formed of acrylic extrusions, each comprising a clear acrylic extrusion 172, 174 and a black acrylic extrusion 176,178. The block 44' illustrated in FIG. 10 is formed by extruding the clear and black portions simultaneously. A similar product can be produced by fastening a separate bevel strip to the edge of a letter block by use of an adhesive, though manufacturing costs are significantly lower when both shapes are produced and joined in a single operation.

The block 44'' illustrated in FIG. 11 is formed using a somewhat different, two-step process. Initially, a solid black profile is extruded and coiled. The profile is then located in appropriate assembly apparatus for lamination to the transparent profile that is subsequently extruded. While the transparent profile is being extruded, the two profiles are fed together and a bond is formed between the two, as the clear extrusion is still hot as it leaves the extrusion press. This process offers the advantage over the co-extrusion process described above in that it only requires a single extrusion press.

The panels and block profiles are preferably formed of acrylic, as is the back sheet. The back sheet is preferably around 1 mm thick.

Figure 12:
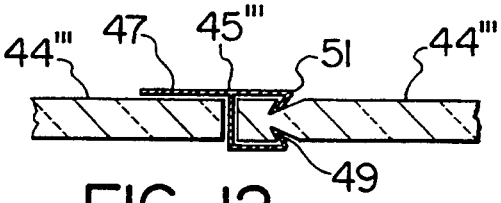
FIG. 12 is a sectional plan view of yet further letter panels for use with the sign of FIG. 1, shown fitted with an end cap.
Figure 13:
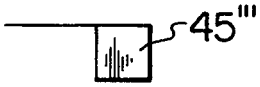
FIG. 13 is a plan view of the end cap of FIG. 12.

FIGS. 12 and 13 illustrate further forms of letter panels 44''' provided with end caps 45''' which are retained on panels 44''' without, the use of adhesive, and which include a flange 47 which extends behind the edge of an adjacent panel. The edges of the panels are provided with inwardly extending grooves 49 which accommodate flanges 51 provided on the end caps 45''' and allow the caps 45''' to be slid onto the ends of the panels. As may be seen from FIG. 13, the upper end of the end cap 45''' is closed to abut the upper end of the edge of the letter panel and serve as a stop for the cap.

The caps 45''' are preferably moulded with a black acrylic compound, while the letter panels 44''' are preferably of injection moulded acrylic.

Figure 14:
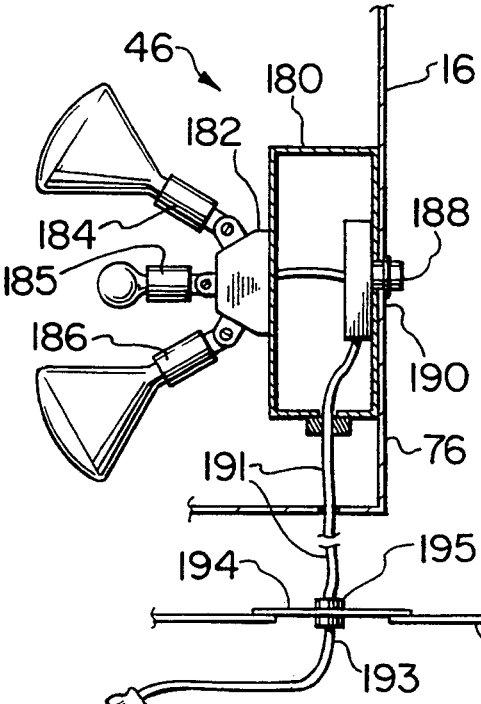
FIG. 14 is a part-sectional view of the light unit of the sign of FIG. 1.

As mentioned above, the light source for the sign is in the form of a floodlight unit 46, which is mounted to the end member 16, as shown in FIG. 2 of the drawings. The floodlight unit 46 is shown in somewhat greater detail in FIG. 14 of the drawings. The unit 46 is self-contained and is supplied to the customer completely assembled to eliminate any requirement for wiring the lighting system during assembly of the sign. This also allows for a ready-to-assemble sign to be shipped to the customer for assembly and use by the customer without obtaining electrical approval for the assembled sign. The unit 46 comprises a cast weatherproof housing 180, fixed to the member 16 by a pair of bolts, with an adjustable mounting bracket 182 which supports two incandescent floodlights 184, 186, and conventional household light 185, between the floodlights.

A light sensor in the form of an electric eye 188 extends from the housing 180 through an aperture 190 in the perimeter wall 76 of the end member 16. Thus, the operation of the unit 46 may be controlled automatically in response to external light conditions. A bolt 157, as illustrated in FIG. 6*b*, may also be provided if the light unit 46 is to be provided at the 'opening' end of the frame.

The power supply lead 191 for the unit extends to a conventional electrical plug 192, the connection cord 193 being held in a strain relief bushing 195 which is fixed in a plate 194 that may be attached to the lower cross member 20 by a pair of bolts.

The floodlights 184, 186 are generally directed towards the opposing end member 14, with the light being reflected from the inner surface of the end member 14 by a primary reflector 196 (FIG. 6*a*)which allows the emitted light to be reflected back towards the light unit to eliminate any dark spots behind the light unit. Secondary reflectors 198, 200 (FIGS. 5, 4) are provided on the upper and lower cross members 18, 20 and the end member 16 to more evenly disperse the light directed to the rear faces of the letter panels 44. The reflectors 196, 198 are in the form of an adhesive-backed, mirrored Mylar (Trademark) sheet. Alternatively, the reflectors may be provided by coating the inner surfaces of the members 14, 16, 18, 20 with a reflective chrome paint.

The conventional light 185 is intended to prevent the appearance of "shadows" between the floodlights 184, 186. The light 185 need not be bright and may use, for example, a 25 w. frosted bulb.

In further embodiments of the present invention, two floodlight units may be provided, one on each of the end members 14, 16. In this case, the electrical connection cord for the second floodlight unit will extend upwardly from the first unit and run along the top and sides of the perimeter frame.

Figure 15:
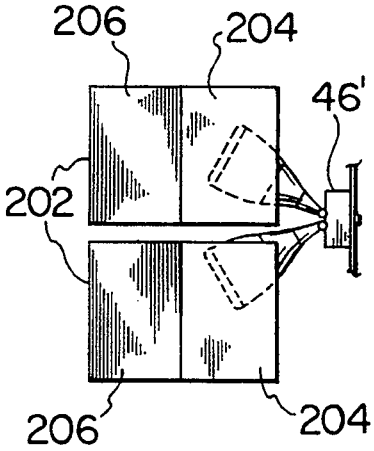
FIG. 15 is a view of a light unit and tint sheet of an embodiment of the present invention.

The floodlight unit 46 would typically be provided with white floodlights 184, 186, though equally could be provided with coloured floodlights to provide the appearance of coloured characters on the face of the sign. Alternatively, tinted back sheets may be provided. Further, in order to provide consistent lighting of the sign, the portions of the back sheet directly adjacent to the floodlights 184, 186 may be more heavily tinted. In a sign provided with transparent back sheets, or in a sign without back sheets, a similar effect may be achieved by providing tinted sheets 202 adjacent the floodlight bulbs, as illustrated in FIG. 15 of the drawings.

In the simplest form, the tint sheet may have an even tint and is fastened using two-sided adhesive tape to the adjacent intermediate cross members. The sheet thus reduces glare from the floodlight bulbs. In the preferred form, as illustrated, each sheet 202 has a white-coated area 204 and a bronze tinted area 206. The white area 204 is located directly beside the floodlight, while the bronze tinted area 206 is spaced further from the floodlight where the glare is not so pronounced.

As mentioned above, the illustrated sign 10 is intended to be shipped in a dismantled condition to a customer who can then easily assemble the sign on site. The configuration of the various elements of the sign facilitates assembly, as will be described herebelow. The end members 14, 16 and the upper and lower cross members 18, 20 are first joined, using the brackets 100, to define the perimeter of the rectangular housing. The brackets 100 are bolted in place. It should also be noted that the flanges of the members have previously been cut to 45° to allow the members to fit together. The intermediate cross members 22, 24, 26, 28 are then bolted to the end members 14, 16.

The light unit is supplied completely assembled and thus only requires to be mounted to the end member 16 by the customer, being fastened to the member using two bolts. The plug end of the electrical supply cable is also secured in the lower cross member 20 using a pair of bolts. The members are supplied with the primary and secondary reflectors 196, 198, 200 already fitted.

The assembled housing is then bolted to the upper horizontal members of the leg supports 50, 52.

After the housing has been assembled, the sign face 32 may be inserted, either in the form of back sheets and letter blocks, or using only bevelled letter blocks or letter blocks provided with end caps 45''' such as illustrated in FIG. 6*a*. After the sign face 32 is in place, the end members 14 is locked in the closed position, preventing unauthorized removal of letter blocks from the sign, and the light unit connected to an appropriate power supply.

It will also be clear that by omitting the intermediate cross members 22, 24, 26, 28 the housing may accommodate a single, solid sign face.

The members 14, 16, 18, 20 are preferably provided in unit lengths and widths, for example, the end members 14, 16 are conveniently 5' long, while the cross members 18, 20 are conveniently 8' long, with the end and cross members are 9" wide. To build a sign of larger area or of greater depth it is more convenient to combine the members of unit length and width, rather than produce special extrusions. For this purpose, various brackets and plates are provided, as illustrated in FIG. 16 and 17 of the drawings, for joining frame members together.

Figure 16:
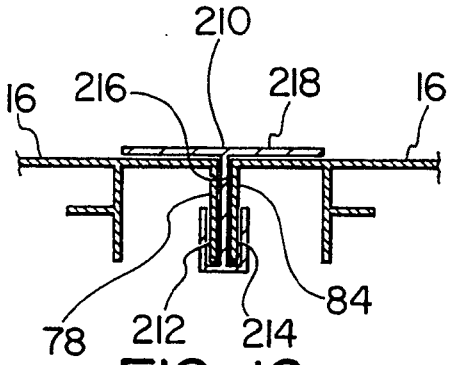
FIG. 16 is a sectional view of frame members of a sign in accordance with the present invention joined in a side-by-side arrangement.

FIG. 16 is a sectional view through two end members 16 joined side by side using a connecting bracket 210 which engages the flanges 78, 84 which partially define the locating channels. The bracket 210 defines two parallel channels 212, 214. A spine portion 216 of the bracket defines a wall of each of the channels 212, 214 and extends over the outer faces of the flanges 78, 84 to a perpendicular head portion 218 which abuts the outer face of the end members 16. The bracket 210 is dimensioned such that it will fit snugly over the edge portions of the end member 16 such that no further fasteners are required and the sign housing remains sealed. Thus, it will be seen that the bracket 210 allows for a very wide sign to be easily packaged as a ready-to-assembly unit.

Figure 17:
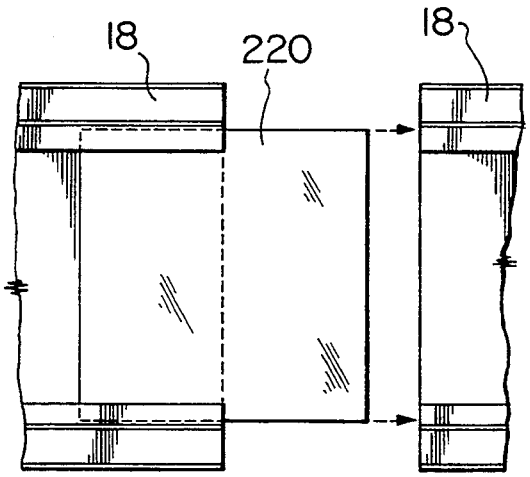
FIG. 17 is a view from below of frame elements of a sign in accordance with the present invention joined end-to-end.
Figure 18:
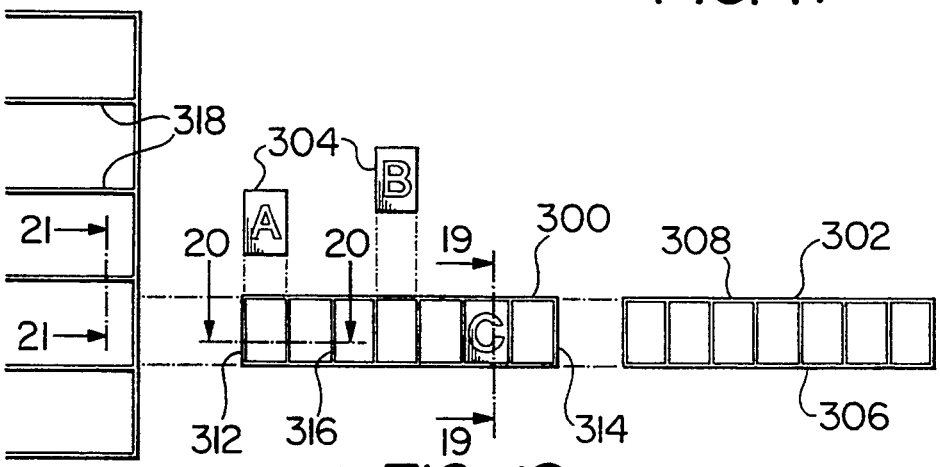
FIG. 18 is an elevational view of an end portion of a sign in accordance with a further embodiment of the present invention.
Figure 20:
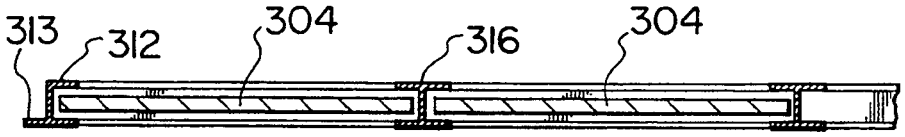
FIG. 20 is a sectional view, on line 20—20 of FIG. 18, shown enlarged and including sectional views of two letter panels.
Figure 19:
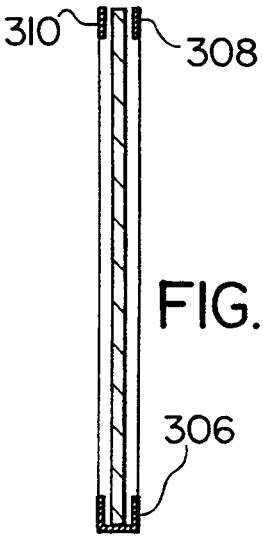
FIG. 19 is a sectional view, on line 19—19 of FIG. 18, shown enlarged.
Figure 21:
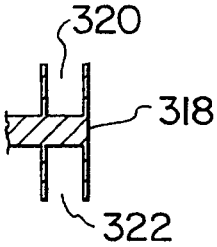
FIG. 21 is a sectional view, on line 21—21, shown enlarged.

Reference is now made to FIG. 17, which illustrates the ends of two upper cross members 18, viewed from below, in the process of being joined end-to-end using a connecting plate 220. The plate is of similar dimensions to a leg of the corner bracket 100 such that it is adapted to be received in the undercut channel provided in each upper or lower cross member 18, 20. The plate 220 may then simply be bolted in place. The plate 220 allows for any length or height of sign to be fabricated as a ready-to-assemble kit making shipping relatively safe and inexpensive due to the relatively short end members 14, 16 and cross members 18, 20 that may be used.

FIGS. 18 through 21 illustrate elements of a sign provided with a somewhat different arrangement for loading letter panels into the sign. Rather than loading panels into a sign one at a time, this embodiment provides cartridges 300, 302, which, in this particular example, accommodate seven letter panels 304. The filled cartridges may then be slid into the sign.

Each cartridge includes a U-shaped bottom rail 306 and two spaced upper rails 308, 310. The rails are joined by end rails 312, 314 and divider rails 316. The divider rails have an I-section and the end rails are formed by cutting an arm from an I-section rail. The end rails 312, 314 on adjacent cartridges are arranged such that the remaining arm 313 will overlap the adjacent rail of the other cartridge.

The letter panels 304 have planar ends and are sized to pass between the upper rails 308, 310 into the appropriate space in the cartridge.

The intermediate cross members 318 are somewhat similar in form to the members 22' illustrated in FIG. 5, but are not provided with the short flange portions, such that the channels 320, 322 defined by the members 318 may easily accommodate a cartridge.

Cartridges may also be provided without divider rails, for accommodating letter panels with bevelled ends, such as illustrated in FIGS. 10 and 11.

The cartridges may be formed of aluminum alloy extrusions, or alternatively of injection moulded structural foam.

Thus, from the above description, it will be clear that the above-described sign provides a strong, weather-tight, tamperproof sign which is relatively easy for a customer to assemble and which, due to the dimensions of the various components, relatively inexpensive to store and transport.

It will be clear to those skilled in the art that the above-described embodiment is merely exemplary of the present invention, and that various modifications and improvements may be made without departing from the scope of the invention. The sign is described as mounted on support legs, but clearly the sign could be supported in any other suitable manner and could, for example, be suspended from a support or fixed to an upright support.

I claim:

1. An illuminated sign, comprising:

a housing having a perimeter frame defined by upright end members and perimeter cross members extending between said upright end members, each of said upright end members and perimeter cross members defining a longitudinally extending, inwardly directed locating channel and an undercut connection channel;

at least one intermediate cross member extending between said upright end members, said intermediate cross member defining two longitudinally extending oppositely directed locating channels;

corner brackets having legs for insertion in said connection channel of an upright end member and a perimeter cross member for securing said members together;

a sign face mounted on said housing having edge portions for placement in said locating channels, said sign face comprising at least two separate sections, one section located between two cross members, each of said sections comprising a back sheet of transparent material, and a plurality of letter panels for location in front of said back sheet, each of said back sheets being of a greater height than each of said letter panels;

each said locating channel being formed with a back portion of receiving an edge of said back sheet and a front portion for receiving an edge of said letter panel, said front portion including a front wall for supporting one of a top and bottom portions of a front face of said letter panel and a panel supporting wall extending rearwardly of said front wall for abutting one of a top and a bottom edge of said letter panel, said back portion having a rear wall for supporting one of a top and a bottom portions of the face of said back sheet, said back sheet extending beyond said panel supporting wall to abut on a supporting wall; and a light source mounted in said housing behind said sign face.

2. The sign of claim 1, wherein each section comprises a plurality of letter panels, at least some of the letter panels being of transparent material and having an opaque covering on a back face, defining a reverse image of a symbol.

3. The sign of claim 2, wherein each of said letter panels has cooperating overlapping ends, one end of said letter panel being of opaque material.

4. The sign of claim 2, wherein each of said letter panels is provided with at least one opaque cap for location over an end of said letter panel to prevent light passing between two adjacent letter panels.

5. The sign of claim 4, wherein each letter panel has inwardly extended grooves to accommodate flanges provided on the cap for retaining the cap on the panel.

6. The sign of claim 4, wherein each said cap has a flange extending from a rear of said cap to said back face of an adjacent letter panel.

7. The sign of claim 2, wherein said plurality of letter panels are mounted side-by-side in at least one cartridge, and the cartridge being slidably received in opposing locating channels.

8. The sign of claim 1, wherein said housing is rectangular and defined by said end members and perimeter cross members, the locating channel of one of said end members being pivotally movable relative to a main body portion of said one of said end members between a closed position and an open position, to allow withdrawal of said sign face from said housing.

9. The sign of claim 8, further including a hinge providing a pivotal connection between the locating channel and said main body portion of said one of said end members.

10. The sign of claim 9, further including a locking plate for location over said one of said end members to prevent opening of the locating channel.

11. The sign of claim 10, further including a locking bracket extending from said one of said end members through an aperture in the locking plate, an end of said locking bracket being adapted to receive a locking fastener.

12. The sign of claim 1, wherein said light source is a self contained light unit mounted to an inner face of one of said end members and said perimeter cross members for directing light towards an opposite member.

13. The sign of claim 12, wherein said opposite member has a reflective surface to reflect light back towards said light unit.

14. The sign of claim 12, wherein a tinted sheet is interposed between said light unit and said sign face to provide or even illumination of said sign face.

15. The sign of claim 14, wherein said light unit includes a floodlight and the tinted sheet has a white coated face portion adjacent said floodlight and a bronze tinted back portion.

16. The sign of claim 12, wherein the other of said end members or said perimeter cross members have reflective inner surfaces to evenly disperse the light.

17. The sign of claim 16, wherein the reflective surfaces are provided by one of a reflective paint and an impact adhesive backed mirrored sheet.

18. The sign of claim 12, wherein said light source includes an external light sensor and said one of said end members and said perimeter cross members has an aperture for receiving said sensor.

19. The sign of claim 1, wherein the light source comprises two self contained floodlight units each mounted to opposing inner faces of one of said end members and said perimeter cross members and each of said floodlight unit directs light towards an opposite member.

20. The sign of claim 1, wherein the light source is in the form of a floodlight unit provided with two floodlight bulbs and a further diffusing bulb between the floodlight bulbs.

21. An illuminated sign as defined in claim 1, wherein each of said upright end members and perimeter cross members is formed with two inwardly directed longitudinally extending locating channels arranged along opposed longitudinal sides of a member to receive two sign faces defining opposed sides of said sign and having edge portions received in said locating channels, the locating channels of one of said upright end members and perimeter cross members being movable to an open position to allow withdrawal of said sign faces from said housing.

22. An illuminated sign as defined in claim 21, said housing being rectangular and the perimeter thereof being defined by said upright end members and perimeter cross members, each of said upright end members and perimeter cross members having an inner face including said two inwardly directed locating channels and said undercut connection channel at least at the ends of said members, and further including right angle corner brackets for reception in the connection channels and joining an end member and a cross member.

23. An illuminated sign comprising:

a housing having a perimeter frame defined by upright end members and perimeter cross members extending between said upright end members, each of said upright end members and said perimeter cross members defining a longitudinally extending, inwardly directed locating channel and an undercut connection channel;

corner brackets having legs for insertion in said connection channel of an upright end member and a perimeter cross member for securing said members together;

a sign face mounted on said housing having edge portions for placement in said locating channels;

a light source mounted in said housing behind said sign face, said light source being a self contained floodlight unit secured to an inner face of one of said upright end members and said perimeter cross members for directing light towards an oppositely disposed member, a tinted sheet interposed between said light unit and said sign face to provide even illumination of said sign face, said tinted sheet having a white coated face portion adjacent said floodlight and a bronze tinted back portion.

24. The sign of claim 23, further including at least three intermediate cross members, said intermediate cross members each defining two longitudinally extending, oppositely directed locating channels, said sign face comprising at least one additional separate section disposed between two adjacent cross members.

25. The sign of claim 24, wherein each of said sections comprises a back sheet of transparent material, and a plurality of letter panels for location in front of the back sheet.

26. The sign of claim 25, wherein each back sheet includes a plurality of upright opaque strips for location behind abutting ends of adjacent letter panels.

27. The sign of claim 26, wherein at least some of the letter panels are of a transparent material and have an opaque covering on a back face, defining a reverse image of a symbol.

28. The sign of claim 23, wherein each locating channel includes a back portion for receiving an edge of a back sheet and a front portion for receiving an edge of a letter panel.

29. The sign of claim 28, wherein said back sheet is of a greater height than said letter panel and each locating channel comprises a front portion including a front wall for supporting one of a front and a bottom portions of said letter panel and a panel supporting wall extending rearwardly of the front wall for abutting on one of a top and bottom edges of said letter panel; and a back portion having a rear wall for supporting one of a top and a bottom portions of a rear face of said back sheet, said back sheet extending beyond said panel supporting wall to abut on a supporting wall.

30. An illuminated sign, comprising:

a housing having a perimeter frame defined by upright end members and perimeter cross members extending between said upright end members, each of said upright end members and perimeter cross members defining a longitudinally extending, inwardly directed locating channel and an undercut connection channel;

at least one intermediate cross member extending between said upright end members, said intermediate cross member defining two longitudinally extending oppositely directed locating channels;

corner brackets having legs for insertion in said connection channel of an upright end member and a perimeter cross member for securing said members together;

a sign face mounted on said housing having edge portion for placement in said locating channels, said sign face comprising at least two separate sections, one section located between two cross members, each of said sections comprising a plurality of letter panels, at least some of said letter panels being of transparent material and having an opaque covering defining a reverse image of a symbol, each said letter panel being provided with at least one opaque cap for location over an end of said letter panel to prevent light dispersion, each letter panel having inwardly extended grooves to accommodate flanges provided on said cap for retaining said cap on said panel.

* * * * *